United States Patent [19]

Palmer et al.

[11] Patent Number: 4,678,690

[45] Date of Patent: Jul. 7, 1987

[54] PREMASKED DECAL

[75] Inventors: Emery A. Palmer, Matthews; Michael A. Shimanski, Charlotte; Thomas M. Ellison, Charlotte; Jack P. Everidge, Charlotte, all of N.C.

[73] Assignee: Rexham Corporation, New York, N.Y.

[21] Appl. No.: 817,671

[22] Filed: Jan. 10, 1986

[51] Int. Cl.[4] ..... B44C 1/165

[52] U.S. Cl. ..... 428/31; 428/40; 428/914

[58] Field of Search ..... 428/31, 40, 914

[56] References Cited

U.S. PATENT DOCUMENTS

| | | | |
|---|---|---|---|
| 3,065,120 | 11/1962 | Avelar | 428/454 |
| 3,192,100 | 6/1965 | Morgan | 428/40 |
| 3,775,226 | 11/1973 | Windorf | 428/216 |
| 3,892,900 | 7/1975 | Shima et al. | 428/40 |
| 3,899,621 | 8/1975 | Willdorf | 428/40 X |
| 3,900,643 | 8/1975 | Kluge et al. | 428/40 |
| 4,101,698 | 7/1978 | Dunning et al. | 428/31 |
| 4,157,417 | 6/1979 | Murphy | 428/429 |
| 4,211,809 | 7/1980 | Barta | 428/201 |
| 4,211,810 | 7/1980 | Barta | 428/201 |
| 4,256,794 | 3/1981 | Meisel | 428/195 |
| 4,310,137 | 1/1982 | Frye | 428/40 X |
| 4,329,396 | 5/1982 | Kropp | 428/354 |
| 4,330,352 | 5/1982 | Grimes et al. | 428/914 X |
| 4,333,781 | 6/1982 | Meulenberg | 428/914 X |
| 4,337,107 | 6/1982 | Eshleman | 428/40 X |
| 4,353,766 | 10/1982 | Dani | 428/480 X |
| 4,604,153 | 8/1986 | Melbye | 428/914 X |

*Primary Examiner*—Henry F. Epstein

*Attorney, Agent, or Firm*—Bell, Seltzer, Park & Gibson

[57] ABSTRACT

A premasked decal comprised of a decal transfer and a strippable tinted transparent premask adhered to the front surface of said decal transfer with the decal transfer being visible therethrough is provided. The premask has either a reflective metallic appearance, a neutral optical density, or preferably both, to impart to the premask a readily visible contrasting appearance against any adjacent background color. This serves to visually indicate the need for removal of the premask from the installed decal transfer. The use of a metal layer to provide a reflective metallic appearance advantageously dissipates static electricity during assembly of the decal so that dust and grit are not attracted thereto.

17 Claims, 4 Drawing Figures

PREMASKED DECAL

TECHNICAL FIELD

This invention relates to premasked decals generally, and particularly relates to a premasked decal which can be easily aligned on an automobile to provide a decal having a smooth surface and an unmarred appearance.

BACKGROUND OF THE INVENTION

Modern automobiles have painted finishes which are far more lustrous than the finishes found on automobiles manufactured even a few years back. This effect is achieved in part by using techniques which produce a paint surface that is far smoother at the microscopic level than techniques providing a less lustrous finish. Such highly lustrous finishes do, however, have disadvantages: contamination of the surface with dust and grit is much more difficult to control, and any scratches or mars are more noticeable and more unsightly.

An unrelated but concurrent development in the automobile industry is the increased popularity of dual color schemes on autos. The preferred method for applying such dual color schemes is as follows: (a) the entire auto is painted one color; (b) a premasked decal, such as a pinstripe, is applied to the auto at the desired location as a break line; (c) the surface of the auto is masked off on one side of the break line; (d) a second paint coat of a different color is applied on the other side of the break line; (e) the finish is baked; and (f) both the premask from the decal and the mask from the other side of the break line are removed.

It is difficult to perform this two-color painting procedure when a smooth surface is also being imparted to the paint to achieve a lustrous finish. This difficulty arises from inadequacies in the premasked decals currently available. A paper premask is currently available, but when a decal having a paper premask is pressed against the painted surface, the textured paper imprints its textured pattern into the decal. Because of this, the decal will have a marred appearance when applied to an automobile having a smooth paint finish.

It is conceivable that a smooth plastic sheeting could be used as a premask. This would not have a texture that would mar the decal, but would result in other disadvantages. Foremost would be the problem of contamination with dust and grit because of the buildup of a static charge during assembly of such a premasked decal.

A premasked decal is itself assembled from two components: a decal transfer portion, and a premask portion. Both of these are typically in the form of large rolls or spools of raw material. The premask portion, before assembly, is adhered to a strippable release liner. During assembly, the decal transfer portion and the premask portion are each continuously unwound, the premask release liner is continuously stripped away, the premask is continuously adhered to the decal, and the premasked decal transfer is continuously wound onto a takeup spool. Individual premasked decals are then cut from the takeup spool. A similar procedure is employed when the decal transfer portion is provided in sheet form.

Because the premask would be plastic, and since the premask release liner would also be plastic, the continuous stripping of one from the other will cause the accumulation of a static charge. This will cause grit and dust to adhere to the premask, and will mar the decal surface when the premask is adhered thereto. Moreover, these mars become more noticeable when noncontaminated portions of the decal are smoothed by the plastic premask, or when the decal is smoothed by heat in the car paint baking process. If the premasked decal is not processed through a paint baking cycle, such dust and grit would still interfere with attempts to smooth the decal surface by other means, such as by press polishing.

Nothing in the prior art provides a premasked decal which overcomes these difficulties.

U.S. Pat. No. 4,337,107 to Eshleman discloses an abrasion-resistant transfer laminating sheet material comprised of, in the following sequence, a strippable carrier, an epoxy-terminated silane polymer layer, a pressure sensitive adhesive, and a strippable release sheet. Acrylic auto paint surfaces are among the suggested substrates to be transfer laminated by this invention, but the invention is directed solely toward imparting protective surfaces, and does not teach how the strippable carrier could be used as a premask, or how the carrier could be altered to solve the aforementioned masking problems. Indeed, the use of the term "carrier" establishes that this disclosure is not directed to premasks at all.

U.S. Pat. Nos. 4,211,809 and 4,211,810 to Barta disclose a self-adhering transfer material comprised of, in the following order, a "picture paper" layer, a separating layer, the transferable design layer, an adhesive layer, and a silicone or foil layer. U.S. Pat. No. 3,065,120 to Avelar discloses a dry transfer decal comprised of, in the following order, a dry release sheet, a transfer structure, and a paper slip sheet. None of these patents have anything to do with premasked decals.

Still other patents are available which describe improved plastic laminates, but these again have nothing to do with premasked decals. Exemplary is U.S. Pat. No. 3,899,621 to Willdorf, which discloses a security film for shatter-proofing windows having a vapor deposited aluminum layer, and which is comprised of at least one polyurethane layer interposed between at least a pair of polyester layers. Also exemplary is U.S. Pat. No. 4,329,396 to Kropp, which discloses a corrosion-resistant reflective or transparent reflective sheet material which may be adhered to a windowpane.

It is accordingly an object of the present invention to provide a premasked decal which can be applied to a substrate without marring the decal.

More specific objects of the invention are to provide a premasked decal which will neither attract dust and grit during assembly nor impart a texture to the decal surface during application to a substrate.

Further objects of the invention are to provide a premasked decal which can be easily aligned on a background of any color, and which will provide an easily observable indication that the premask layer has not been removed from the decal transfer.

SUMMARY OF THE INVENTION

In accordance with the present invention, applicant provides a premasked decal comprised of a decal transfer and a strippable tinted transparent premask adhered to the front surface of the decal transfer with the decal transfer being visible therethrough.

By "decal transfer" we mean a layer which can be laminated to a substrate to provide decoration or protection thereto. The decal transfer is preferably comprised of a decal layer, an adhesive layer on the rear surface of the decal layer, and a strippable release sheet adhered to the adhesive layer. The tinted premask has a reflective metallic appearance or a neutral optical density, or preferably both, and an optical density of from 0.1 to 0.9. These features impart to the premask a readily visible contrasting appearance against any adjacent background color, as will be required if the same premask is used with different colored decals and different colored substrates.

Advantageously, this contrasting appearance (1) aids in aligning the decal on the substrate, and (2) provides a convenient visual indication of whether or not the premask has been removed therefrom. A further advantage of the invention is that each of the aforesaid advantages is obtained regardless of the color of either the decal used or the substrate to which it has been applied. At the same time, the premasked decal does not mar the finish of the substrate to which it is applied because the premask is constructed of a relatively smooth polymeric film which will not impart a texture to the substrate when it is pressed thereon. Insofar as applicant is aware, nothing which provides these advantages has ever been suggested or made available.

BRIEF DESCRIPTION OF THE DRAWINGS

The foregoing and other objects, features and advantages of the invention will be made apparent from the following description of the preferred embodiments and the drawings, in which.

DETAILED DESCRIPTION OF THE INVENTION

Figure 1:
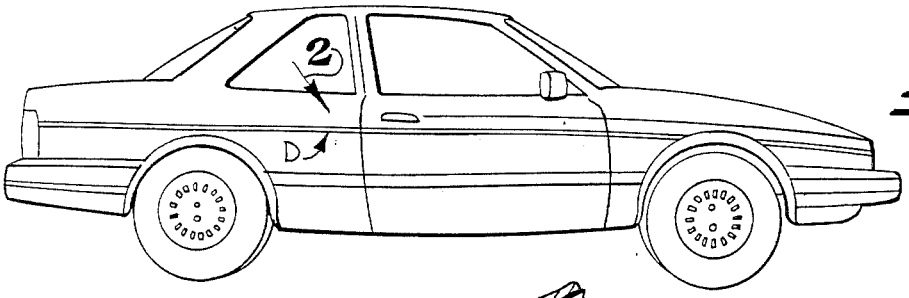
FIG. 1 illustrates a premasked decal, generally indicated by letter D, adhered to the side of an automobile.
Figure 2:
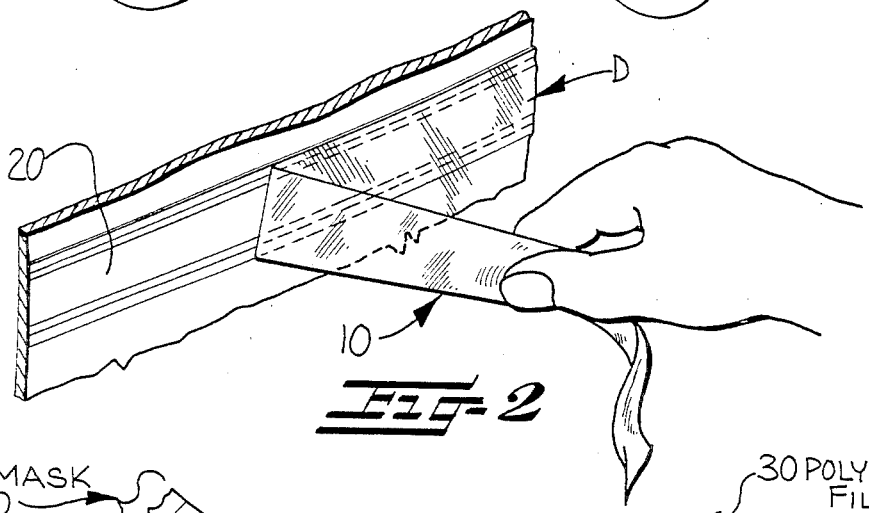
FIG. 2 is a perspective view of a premasked decal adhered to a substrate, with the premask layer in the process of being stripped away.

FIGS. 1 and 2 illustrate a premasked decal D of the present invention applied to the side of an automobile as a pinstripe. FIG. 2 illustrates the area generally indicated by arrow 2 in FIG. 1. The decal layer 20 has been adhered to the automobile, and the premask 10 is in the process of being removed therefrom.

Figure 3:
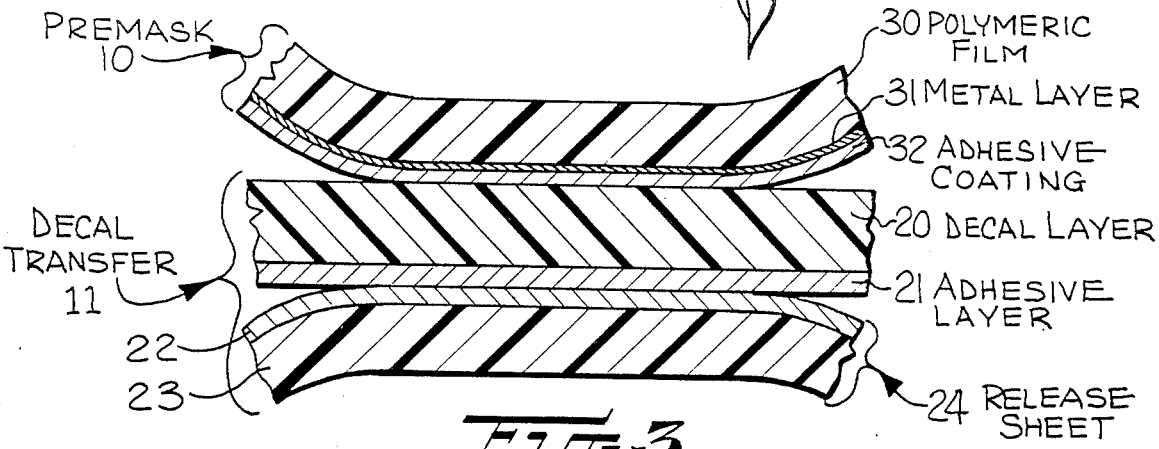
FIG. 3 illustrates a premasked decal of the present invention in which a metallic appearance has been imparted to the premask by a metal coating on the premask.

FIG. 3 reveals a strippable tinted transparent premask 10 adhered to the front surface of a decal transfer 11. The decal transfer, or more particularly the decal layer 20, is visible through the premask, as will be explained below. In this preferred embodiment, the decal transfer set forth as an example in FIG. 3 is comprised of a decal layer 20 formed of a flexible film which may be pigmented and/or printed in one or more colors to form a decorative layer, a pressure-sensitive adhesive layer 21 carried by the rear surface of the decal layer for adhering the decal layer to a substrate, and a strippable release sheet 24 adhered to the adhesive layer for protecting the adhesive layer prior to the application of the decal layer to the substrate. Decals such as this may be embodied as accent stripes, pinstripes, decorative designs or motifs, or as protective coatings with or without decoration. Decal transfers such as this are well known in the art, and the particular decal transfer set forth above is provided by way of illustration and not of limitation.

The invention can alternatively be embodied with other well-known types of decals, such as decals in which multiple layers are adhered to the substrate, or with decals having a different adhesive system such as a water-activated adhesive. In the illustrated embodiment, the release sheet is comprised of a silicone release coat 22 and a sheet of backing material 23. Such release sheets are well known in the art.

In the preferred embodiment of FIG. 3, the premask is comprised of a transparent polymeric film 30, a metal layer 31, and a releasable adhesive coating 32. The polymeric film can be any clear film, such as polypropylene, polystyrene, polyethylene, polyester or acrylic. Polyester is particularly preferred because of its heat resistance, as will be explained in the discussion of paintable premasked decals below, and is available from Du Pont under the the trademark Mylar or from I.C.I. under the trademark Melinex. The thickness of the polymeric film is not critical so long as flexibility and good masking properties are obtained, but the preferred range is from 0.00025 to 0.020 inches.

The releasable adhesive coating 32 can be any of the standard pressure-sensitive adhesives such as rubber based urethane, or, preferably, acrylate adhesives. If the premasked decal is to serve as a paintable premasked decal, that is, if the premask must withstand a paint baking cycle, the adhesive should be selected so that it will not leave a residue on the decal after baking at 110° C. for one hour. The thickness of the adhesive coating preferably ranges from 0.0002 to 0.002 inches.

The metal layer 31, which can be coated on either side of the polymeric film, is most desirably aluminum, which is conveniently vacuum or vapor deposited in a substantially uniform layer of thinness so as to not unduly reduce the transparency of the premask while at the same time imparting a metallic reflectiveness thereto. The thickness of the metal layer should be such as provides the premask with an optical density in the visible spectrum of from 0.1 to 0.9 or, more preferably, 0.28 to 0.38 to give the premask a tinted transparent appearance. While a vapor deposited aluminum coating is particularly preferred, other metals can be used which can be coated or deposited on the polymeric film or dispersed therein by other known procedures. Illustrative of such other metals are chromium, zinc, copper, silver and gold.

A metal layer such as aluminum is preferred because it imparts both a reflective metallic appearance and a neutral optical density to the premask. By "neutral optical density" we mean that the metallic layer is substantially equally reflective of all colors of light (or all wavelengths of light in the visible spectrum), and substantially equally transmittive of all colors of light (allows all colors of light to pass through equally). Such a premask can be distinguished against a background of any color because, when viewed through the premask, backgrounds of different colors are uniformly altered in appearance.

Also within the scope of the present invention are reflective metallic layers which do not have a neutral optical density. Exemplary is a gold layer, which would provide a reflective surface with a yellow caste. Because of its reflectiveness, such a premask would be visible against backgrounds of any color, but would be less advantageously applied to background colors approaching the caste of the reflective metallic layer. For example, a premask having a gold layer would less advantageously be applied to a substrate providing a yellow background color.

Also within the scope of the present invention are premasked decals in which the premask has been tinted such that a neutral optical density has been imparted to the premask without imparting to the premask a reflective metallic appearance. Such a premask would simply serve to uniformly decrease the amount of any color of light passing therethrough. Thus a background of any color would appear darker when viewed through the premask, but the more striking appearance of a reflective premask would not be obtained.

The metallic coating advantageously dissipates static electricity which accumulates during assembly of the premasked decal. As explained in the background section above, the accumulation of such a static charge would otherwise attract dust and grit to the decal and result in a marred appearance on the decal when the premask is applied thereto.

Figure 4:
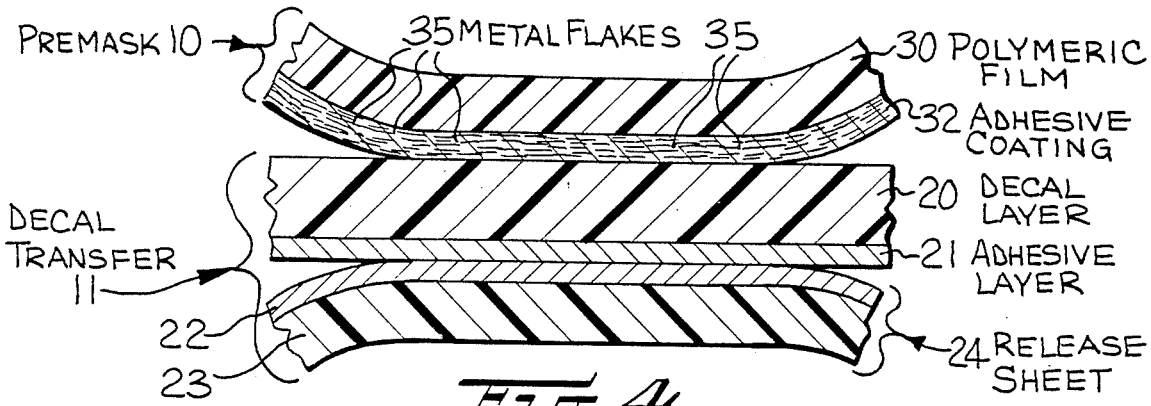
FIG. 4 illustrates a premasked decal of the present invention in which a metallic appearance has been imparted to the premask by dispersing pigments in the adhesive of the premask.

FIG. 4 reveals an alternate embodiment of the present invention. The premasked decal is again comprised of a premask 10 and a decal transfer 11. The decal transfer is again, by way of illustration and not of limitation, comprised of a decal layer 20, an adhesive layer 21 and a strippable release sheet 24. The release sheet is again typically comprised of a silicone release coat 22 and a backing material 23.

It will be immediately apparent that this embodiment is not provided with a metal layer. Instead, metallic flakes 35 were dispersed in the releasable adhesive coating 32 to achieve the same metallic appearance and optical density as if a metal layer was deposited on the polymeric film 30. We used aluminum flakes of the type added to automobile paints to achieve a metallic paint finish in a concentration of one part flakes to seven parts adhesive by weight. As an alternative to aluminum flakes, other metal flakes, powders or pigments can be used to provide an indication that the premask layer remains on the decal and to aid in registering the decal on the substrate. Further, nacreous pigments such as iron oxide or titanium dioxide-coated mica platelets could also be used. It will also be apparent to those skilled in the art that such pigments can be dispersed within the polymeric film 30 by known methods to achieve the same desired metallic appearance and optical density of the premask.

Our studies indicate that metallic flakes dispersed in the adhesive coating do not dissipate static electricity as effectively as a metal layer on the polymeric film during assembly of the premasked decal. Therefore, when contamination by dust and grit is of particular concern, the use of a metal layer will be preferred.

The foregoing embodiments are to be considered illustrative rather than restrictive of the invention, and those modifications which come within the meaning and range of equivalents of the claims are to be included therein.

That which is claimed is:

1. A premasked decal, comprising:

a decal transfer; and a strippable tinted transparent premask adhered to the front surface of said decal transfer with the decal transfer being visible therethrough, said premask having a neutral optical density of from 0.1 to 0.9 to impart to the premask a readily visible contrasting appearance against any adjacent background color so as to visually indicate the need for removal of the premask from the installed decal transfer.

2. A premasked decal according to claim 1, wherein said tinted transparent premask exhibits a reflective appearance to further impart to the premask said readily visible contrasting appearance.

3. A premasked decal according to claim 1, wherein said tinted transparent premask includes a metal coating providing said neutral optical density and said readily visible contrasting appearance.

4. A premasked decal according to claim 1, wherein said premask comprises a flexible transparent polymeric film and a releasable adhesive coating bonding said flexible film to the front surface of said decal transfer.

5. A premasked decal according to claim 1, wherein said decal transfer comprises a flexible decal layer, a pressure-sensitive adhesive layer carried by the rear surface of said decal layer for adhering the decal layer to a substrate, and a strippable protective release sheet adhered to said adhesive layer.

6. A premasked decal, comprising:

a decal transfer; and a strippable tinted transparent premask adhered to the front surface of said decal transfer with the decal transfer being visible therethrough, said premask comprising a flexible polymeric film having a transparent reflective metal coating on one surface, and a releasable adhesive coating bonding said flexible film to the front surface of said decal transfer, said metal coating imparting an optical density of from 0.1 to 0.9 to said premask to impart to the premask a readily visible contrasting appearance against any adjacent background color so as to visually indicate the need for removal of the premask from the installed decal transfer.

7. A premasked decal, comprising:

a decal transfer; and a strippable tinted transparent premask adhered to the front surface of said decal transfer with the decal transfer being visible therethrough, said premask comprising a flexible polymeric film and a releasable adhesive coating bonding said flexible film to the top surface of said decal transfer, said releasable adhesive coating having dispersed therein metallic pigments in a concentration sufficient to impart to said premask a metallic appearance and an optical density of from 0.1 to 0.9 to impart to the premask a readily visible contrasting appearance against any adjacent background color so as to visually indicate the need for removal of the premask from the installed decal transfer.

8. A premasked decal, comprising:

a decal transfer; and a strippable tinted transparent premask adhered to the front surface of said decal transfer with the decal transfer being visible therethrough, said premask comprising a flexible polymeric film and a releasable adhesive coating bonding said flexible film to the top surface of said decal transfer, said polymeric film having dispersed therein metallic pigments in a concentration sufficient to impart to said premask a metallic appearance and an optical density of from 0.1 to 0.9 to impart to the premask a readily visible contrasting appearance against any adjacent background color so as to visually indicate the need for removal of the premask from the installed decal transfer.

9. A premasked decal as claimed in claims 6, 7 or 8, wherein said flexible polymeric film is a heat-resistant film.

10. A premasked decal as claimed in claim 9, wherein said heat-resistant film is a polyester film.

11. A premasked decal as claimed in claims 6, 7 or 8, wherein the optical density of said premask is from 0.28 to 0.38.

12. A premasked decal, comprising:

(a) a decal layer;

(b) a pressure-sensitive adhesive layer carried by the rear surface of said decal layer for adhering the decal layer to a substrate;

(c) a strippable release sheet adhered to said adhesive layer; and (d) a strippable tinted transparent premask adhered to the front surface of said decal layer with the decal layer being visible therethrough, said premask comprising a flexible polymeric film having a transparent reflective metal coating on one surface, and a releasable adhesive coating bonding said flexible film to the top surface of said decal layer, said metal coating imparting an optical density of from 0.1 to 0.9 to said premask to impart to the premask a readily visible contrasting appearance against any adjacent background color so as to visually indicate the need for removal of the premask from the installed decal transfer.

13. A premasked decal, comprising (a) a decal layer;

(b) a pressure-sensitive adhesive layer carried by the rear surface of said decal layer for adhering the decal layer to a substrate;

(c) a strippable release sheet adhered to said adhesive layer; and (d) a strippable tinted transparent premask adhered to the front surface of said decal layer with the decal layer being visible therethrough, said premask comprising a flexible polymeric film and a releasable adhesive coating bonding said flexible film to the top surface of said decal layer, said releasable adhesive coating having dispersed therein metallic pigments in a concentration sufficient to impart to said premask a metallic appearance and an optical density of from 0.1 to 0.9 to impart to the premask a readily visible contrasting appearance against any adjacent background color so as to visually indicate the need for removal of the premask from the installed decal layer.

14. A premasked decal, comprising (a) a decal layer;

(b) a pressure-sensitive adhesive layer carried by the rear surface of said decal layer for adhering the decal layer to a substrate;

(c) a strippable release sheet adhered to said adhesive layer; and (d) a strippable tinted transparent premask adhered to the front surface of said decal layer with the decal layer being visible therethrough, said premask comprising a flexible polymeric film and a releasable adhesive coating bonding said flexible film to the top surface of said decal layer, said polymeric film having dispersed therein metallic pigments in a concentration sufficient to impart to said premask a metallic appearance and an optical density of from 0.1 to 0.9 to impart to the premask a readily visible contrasting appearance against any adjacent background color so as to visually indicate the need for removal of the premask from the installed decal layer.

15. A premasked decal as claimed in claims 12, 13 or 14, wherein said flexible polymeric film is a heat-resistant polymeric film.

16. A premasked decal as claimed in claim 15, wherein said heat-resistant polymeric film is a polyester film.

17. A premasked decal as claimed in claims 12, 13 or 14, wherein the optical density of said premask is from 0.28 to 0.38.

* * * * *